US010351959B2

(12) United States Patent
Grabowski et al.

(10) Patent No.: US 10,351,959 B2
(45) Date of Patent: Jul. 16, 2019

(54) METHOD FOR PASSIVATING A METALLIC SURFACE

(71) Applicant: AUDI AG, Ingolstadt (DE)

(72) Inventors: Michael Grabowski, Schwabach (DE); Daniel Blücher, Trondheim (NO); Michael Korte, Ingolstadt (DE); Matthias Brettmann, Leinburg (DE); Sannakaisa Virtanen, Erlangen (DE)

(73) Assignee: AUDI AG, Ingolstadt (DE)

( * ) Notice: Subject to any disclaimer, the term of this patent is extended or adjusted under 35 U.S.C. 154(b) by 396 days.

(21) Appl. No.: 15/303,376

(22) PCT Filed: Mar. 21, 2015

(86) PCT No.: PCT/EP2015/000622
§ 371 (c)(1),
(2) Date: Oct. 11, 2016

(87) PCT Pub. No.: WO2015/154851
PCT Pub. Date: Oct. 15, 2015

(65) Prior Publication Data

US 2017/0037517 A1 Feb. 9, 2017

(30) Foreign Application Priority Data

Apr. 11, 2014 (DE) ..... 10 2014 005 444

(51) Int. Cl.
*C23C 22/56* (2006.01)
*C25D 9/12* (2006.01)
(Continued)

(52) U.S. Cl.
CPC ..... *C23C 22/22* (2013.01); *C23C 22/68* (2013.01); *C25D 13/20* (2013.01); *C25D 13/22* (2013.01)

(58) Field of Classification Search
CPC ..... C23C 22/54–57; C25D 9/08–12
See application file for complete search history.

(56) References Cited

U.S. PATENT DOCUMENTS

2004/0121451 A1 6/2004 Moritz et al.
2008/0097618 A1 4/2008 Baker et al.
(Continued)

FOREIGN PATENT DOCUMENTS

CN 101061194 10/2007
CN 101285193 10/2008
(Continued)

OTHER PUBLICATIONS

Chinese Search Report dated May 27, 2017 with respect to counterpart Chinese patent application 201580018917.7.
(Continued)

*Primary Examiner* — Lois L Zheng
(74) *Attorney, Agent, or Firm* — Henry M. Feiereisen LLC

(57) ABSTRACT

A method for passivating a metal surface of a light-weight metal part is disclosed, wherein a conversion layer is applied to the surface of the light-weight metal part in a passivation step. A passivation step is carried out wherein an aqueous passivation solution is used to create a calcium phosphate-containing conversion layer (5) on the metal surface of the part, said conversion layer comprising oxides and hydroxides from the material of the part and from the passivation solution and containing amino acids.

17 Claims, 3 Drawing Sheets

(51) Int. Cl.

| | |
|---|---|
| ***C23C 22/22*** | (2006.01) |
| ***C25D 13/20*** | (2006.01) |
| ***C23C 22/68*** | (2006.01) |
| ***C25D 13/22*** | (2006.01) |
| *C23C 22/00* | (2006.01) |
| *C25D 9/00* | (2006.01) |

(56) References Cited

U.S. PATENT DOCUMENTS

| | | | | |
|---|---|---|---|---|
| 2013/0206528 | A1 | 8/2013 | Enning et al. | |
| 2015/0132356 | A1* | 5/2015 | Beniash et al. ..... | A61L 27/34 424/423 |

FOREIGN PATENT DOCUMENTS

| | | | |
|---|---|---|---|
| CN | 102690558 | | 9/2012 |
| DE | 196 30 289 | A1 | 1/1998 |
| DE | 10 2010 060 700 | A1 | 5/2012 |
| JP | 2009-114504 | | 5/2009 |
| KR | 2012-0013648 | | 2/2012 |

OTHER PUBLICATIONS

Translation of Chinese Search Report dated May 27, 2017 with respect to counterpart Chinese patent application 201580018917.7.

English International Search Report issued by the European Patent Office in International Application PCT/EP2015/000622.

Gu X N et al: "Influence of artificial biological fluid composition on the biocorrosion of potential orthopedic Mg—Ca, AZ31, AZ91 alloys, Influence of artificial biological fluid composition on the biorrosion of potential orthopedic Mg—Ca, AZ31, AZ91 alloys", Biomedical Materials, Institute of Physics Publishing, Bristol, GB, vol. 4, No. 6, Dec. 1, 2009; p. 65011.

Xin Y et al: "studies of biomedical magnesium alloys in a simulated physiological environment: A review", Acta Biomaterialia, Elsevier, Amsterdam, NL, vol. 7, No. 4, Dec. 3, 2010, pp. 1452-1459.

Hiromoto S et al: High corrosion resistance of magnesium coated with hydroxyapatite directly synthesized in an aqueous solution, Electrochimica Acta, Elsevier Science Publishers, Barking, GB, vol. 54, No. 27, Nov. 30, 2009, pp. 7085-7093.

* cited by examiner

METHOD FOR PASSIVATING A METALLIC SURFACE

CROSS-REFERENCES TO RELATED APPLICATIONS

This application is the U.S. National Stage of International Application No. PCT/EP2015/000622, filed Mar. 21, 2015, which designated the United States and has been published as International Publication No. WO 2015/154851 and which claims the priority of German Patent Application, Serial No. 10 2014 005 444.6, filed Apr. 11, 2014, pursuant to 35 U.S.C. 119(a)-(d).

BACKGROUND OF THE INVENTION

The invention relates to a method for passivating a metallic surface of a lightweight metal component and a passivation solution for forming a conversion layer for the metallic surface of the lightweight metal component.

The use of lightweight metal components is common practice across industries. Especially in vehicle construction for example vehicle bodies can be manufactured as composite construction for example from lightweight metal and steel parts in order to reduce weight. The lightweight metals can for example be aluminum or magnesium materials or alloys thereof.

From DE 196 30 289 C2 a generic method for painting vehicle bodies is known. According to this the body-in-white is subjected to a pre-treatment prior to the actual painting process in which pre-treatment vehicle bodies are first degreased in a spray- and full submersion zone. Subsequently the cleaned vehicle bodies are coated with a zinc-phosphate layer in a phosphate bath. This layer serves as additional corrosion protection and as a bonding agent for the subsequent primer application. Subsequent to this pre-treatment step a cataphoresis-priming is performed in the dip method in which an electric direct voltage is applied and the paint particles that are dissolved in the dip bath are attracted by the sheet metal of the vehicle body where they adhere to form a primer coat. Subsequently the primed vehicle body is transported into a downstream continuous furnace in which the primer coat is burned in. Subsequent thereto the vehicle body that is provided with the primer coat is transported to a further coating station in which a top coat in the color requested by the customer is applied. Hereby the paint particles can be transported through an electrostatic field from support heads that are under high voltage to the grounded vehicle body. Downstream of this top coating process also a continuous furnace is arranged in which temperature a the topcoat is cured at high temperature. Subsequently a clear varnish is applied in a further coating station, which clear varnish is cured at high temperature.

In vehicle bodies produced with a composite construction method the lightweight metal components (made of Mg or Al) are more corrosion sensitive compared to the steel components. In particular paint creeps and filiform corrosion are frequent causes for damage. In order to protect the lightweight metal components it is common to use a pickling passivation and to apply an anodic coating. The commercial coatings however only offer limited required protection against self-corrosion, filiform corrosion and/or paint creep. In particular in contact with magnesium the high potential difference promotes corrosion.

The commercially available coating systems for lightweight components do not have sufficient passivating properties and are oftentimes too "noble" relative to magnesium (i.e., excessive corrosion potentials). When magnesium alloys are electrochemically polarized with more noble metals (for example aluminum) the corrosion current increases exponentially.

SUMMARY OF THE INVENTION

It is an object of the invention to provide a method for passivating the metallic surface of a lightweight metal component, which in particular in the case of aluminum or magnesium achieves a sufficient passivation and reduces the risk of contact corrosion.

The object is solved by the features of the independent patent claim 1. Preferred refinement of the invention are set forth in the dependent claims.

The invention is based on the idea to generally model the composition of the passivation solution based on the composition of human blood. Surprisingly it was found that certain components of human blood generate a protective and passivating coating on metal surfaces, in particular of lightweight metal such as aluminum and/or magnesium. In a particular embodiment of the invention concentrations of individual components can be reconstructed in the passivation solution essentially unchanged. In light of the foregoing the characterizing portion of patent claim 1 sets forth a special passivating step in which a calcium phosphate containing conversion layer is generated on the metallic component surface using a aqueous, in particular blood-like, passivation solution which conversion layer contains oxides and hydroxides of the component material and the passivation solution, and further contains amino acids.

The lightweight metal provided with the passivated metallic surface can be used across industries. For example the lightweight component can be used in the medical field. As an alternative the lightweight metal component can be used in the automobile field, i.e., non-visibly inside the vehicle or as an externally visible outer part. The lightweight metal component can for example be a display frame inside the vehicle, an aggregate part, a chassis part or a component of a set frame structure.

The corrosion protection primer (i.e. the conversion layer) that has a passivating effect reduces the self-corrosion currents by the factor 10. In addition the pitting potential is reduced by more than 0.5 V while at the same time the cathodic current densities are reduced. Hereby the conversion layer according to the invention has advantageous properties regarding contact with other more noble materials (such as aluminum or steel). In addition the conversion layer according to the invention reduces contact corrosion currents with aluminum, steel, zinc, carbon fibers or CFK. In addition the crossover resistance increases as a result of application of the coating (i.e., the higher the crossover resistance the smaller the corrosion currents; the crossover resistance is inversely proportional to the corrosion currents). In addition a passive behavior is generated in which significantly smaller global corrosion currents occur. In contrast in conventional conversion layers a multitude of finely distributed local corrosion sites result. Overall the conversion layer according to the invention generates low self-corrosion currents and a high passivity. In the case of contact with aluminum and steel only small corrosion currents result.

In a component material made of aluminum the passivation solution results in a compact calcium phosphate and aluminum hydroxide containing coating with amino acids. The layer morphology is hereby constructed floe-like, i.e., with interspersed cracks, which for example in a KTLprecipitation following a painting process lead to increased residual conductivity. In addition the liquid starting-component of the primer coat can enter into the cracks, which results in a good adhesion of the conversion layer and the primer coat.

As an alternative in a component material made of magnesium a compact calcium phosphate and magnesium hydroxide/oxide-containing coating results whose layer morphology is also constructed floe-like.

In the following, further optional features of the invention are described: The passivation solution can preferably include at least the following components as activators for activating the metal surface of the component:

NaCl with a concentration between 5500 and 7500 in particular 6400 mg/l; and/or

KCl with a concentration between 300 and 500, in particular 400 mg/l.

NaCl and KCl both act as a chloride source and support an activation of the layer formation in which increasingly ions of the material which are required for the layer formation are dissolved out of the surface of the component.

In addition the passivation solution can contain at least the following amino acids as catalysts and layer formers:

D-Ca-pantothenate with a concentration between 2 and 5, in particular 4 mg/l; and/or Myo-Inositol with a concentration between 5 and 9, in particular 7.2 mg/l and/or L-Isoleucine with a concentration between 80 and 120, in particular 105 mg/l.

The amino acid L-Isoleucine hereby acts especially as a layer adhesion agent, which supports adhesion of the conversion layer on the metallic component surface.

For supporting the layer formation, additionally $Ca^{2+}$ and/or $PO_4^{-3}$ ions are incorporated as fragments in the conversion layer. In this case the passivation layer can preferably contain calcium phosphates.

In addition the conversion layer can have carbonate containing components. For providing such carbon carbonate containing layer components the passivation solution can contain $NaHCO_3$. The carbonate formation is in addition dependent on optionally included $CO_2$.

As further auxiliary material for supporting the layer formation the passivation solution can also contain Na-Pyruvate, i.e., in a concentration between 90 and 150 mg/l in particular 110 mg/l.

As described above an important aspect of the invention is that certain components of the human blood are used in the passivation solution in essentially unchanged concentration. Correspondingly in an embodiment the aqueous passivation solution can contain at least the following components whose concentration is modeled based on their concentration in human blood:

NaCl with in particular 6400 mg/l
KCl with in particular 400 mg/l
NaH2PO4 with in particular 124 mg/l
$CaCl_2$ with in particular 200 mg/l
$NaHCO_3$ with in particular 3700 mg/l
Na-Pyruvate with in particular 110 mg/l
D-Ca-pantothenate with in particular 4 mg/l
Myo-Inositol with in particular 7.2 mg/l
L-Isoleucine with in particular 105 mg/l.

Important for the coating behavior are at least one or more, in particular all of the following components of the passivation solution:

L-Arginine with in particular 84 mg/l
L-Cysteine with in particular 48 mg/l
L-Histidine.HCl.H2O with in particular 42 mg/l
L-Leucine with in particular 105 mg/l
L-Lysin.HCl with in particular 146 mg/l
L-Methionine with in particular 30 mg/l
L-Penthylalanine with in particular 66 mg/l
L-Threonine with in particular 95 mg/l
L-Tryptophan with in particular 16 mg/l
L-Tyrosine with in particular 72 mg/l
L-Valine with in particular 94 mg/l
L-Serine with in particular 42 mg/l
Colin chloride with in particular 4 mg/l
Folic acid with in particular 4 mg/l
Nicotine amide with in particular 4 mg/l
Pyridoxale.HCl with in particular 4 mg/l
Riboflavine with in particular 0.4 mg/l
Thiamine-HCl with in particular 4 mg/l The passivation reaction according to the invention can take place at a pH value of about 7. In this case the coating reaction only proceeds slowly. As an alternative the coating reaction can also take place in the acid range. The coating reaction can be accelerated by increasing the temperature, reducing the pH value and/or by polarizing and/or increasing the partial pressure of $CO_2$.

In a special application the lightweight metal components can be a vehicle component, which is first pre-treated with the passivation solution according to the invention under forming the conversion layer. The conversion layer of the component an in a subsequent coating process be covered at least partially with a further layer.

The coating process can for example include a first coating step in which a lightweight metal KTL-layer, i.e., an organic protective layer, is formed. This is accomplished in a dip method (i.e., lightweight metal KTL) with applied direct voltage, wherein the paint particles dissolved in the dip bath are attracted by the metallic part where they adhere and form the lightweight metal KTL layer. In a further coating step a powder coating is then applied. This occurs in a powder coating process with applied direct voltage. With regard to a reliable coating process the already mentioned special floe-like layer morphology with the crack structures is important. This ensures a sufficient residual electrical conductivity through the conversion layer in the dip coating and in the powder coating process.

In a possible application the lightweight metal component, for example as visible outer part, can be joined to the not yet painted body-in-white subsequent to the component coating process. The body-in-white, together with the lightweight metal component attached thereon, is then subjected to a conventional vehicle body painting process. This means a cataphoreseis priming of the vehicle body is performed in a dip-method with applied electrical direct voltage in which the paint particles dissolved in the dip bath are attracted by the body-in-white where they adhere and form a primer coat. Subsequently the primed body-in-white is transported into a downstream continuous furnace in which the primer coat is burned in. Subsequent thereto the body-in-white having the primer coat is transported to a further coating station in which a KTL-process is performed. Downstream of the KTL-process a continuous furnace is also arranged in which the KTL-layer is burned in at high temperature. Subsequently in a further coating station a conventional automobile varnish is applied which is also burned in at high temperature in a subsequent drying step.

In the above vehicle body painting process the lightweight metal component mounted on the body-in-white is already pre-coated with layers, i.e. with the conversion layer, the lightweight metal KTL-layer and the powder layer. The lightweight metal component is thus electrically insulated so that the KTL-layer that was electrically applied on the body-in-white painting process no longer adheres while the conventional automobile varnish structure can be applied to the already coated lightweight metal component without problems.

The advantageous embodiments and/or refinements of the invention explained above and/or set forth in the dependent claims can be used individually or in any desired combination—except for example in case of clear dependencies or irreconcilable alternatives.

BRIEF DESCRIPTION OF THE DRAWING

In the following the invention and its advantageous embodiments and refinements and their advantages are explained in more detail by way of drawings.

It is shown in.

DETAILED DESCRIPTION OF PREFERRED EMBODIMENTS

Figure 1:
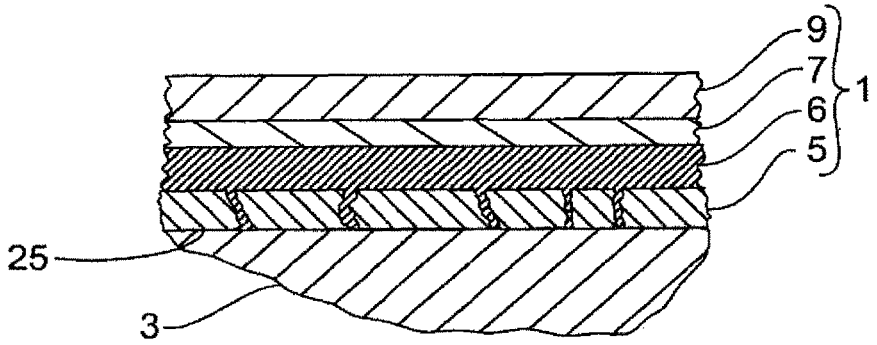
FIG. 1 the layer construction of a finished painted lightweight metal component which in this case exemplarily shows an outer part that can be arranged externally on the vehicle body.

FIG. 1 exemplarily shows in a strongly enlarged partial sectional view the layer construction 1 of a paint coating on the metal surface 25 of a vehicle body component 3. As an example the vehicle body component 3 is in this case made of a lightweight metal, for example aluminum, magnesium, or an alloy thereof. Accordingly the layer formation 1 has directly bordering the material surface 25 of the lightweight metal component 3 a conversion layer 5, which serves for passivation and corrosion protection. The conversion layer 5 is covered by a lightweight metal KTL-layer 6. On the lightweight metal KTL-layer a powder layer 7 is formed on which a conventional varnish formation 9 is applied. As shown in FIG. 1 the conversion layer 5 has a floe-like layer morphology in which cracks 13 are formed between individual floes 11. In a KTL coating process described below the cracks 13 ensure a sufficient residual conductivity between a KTL-dip bath and the lightweight metal material of the component 3. In addition the liquid starting component of the lightweight metal KTL layer 6 can enter the cracks 13 during the multi-step coating process and thereby increase the adhesive connection to the conversion layer 5.

FIG. 1 and also the further FIGS. 2 to 7 have been prepared with the goal to facilitate understanding of the invention. Therefore the figures are strongly simplified representations, which do not reflect a realistic layer for formation 1. Thus the conversion layer 5 in actuality has a layer thickness in the μm range.

Figure 2:
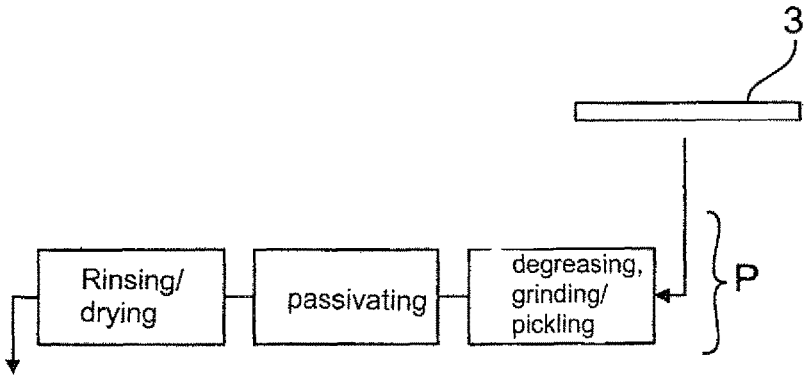
FIGS. 2 to 4 respective flow charts which illustrate the coating processes for producing the layer construction shown in FIG. 1.
Figure 3:
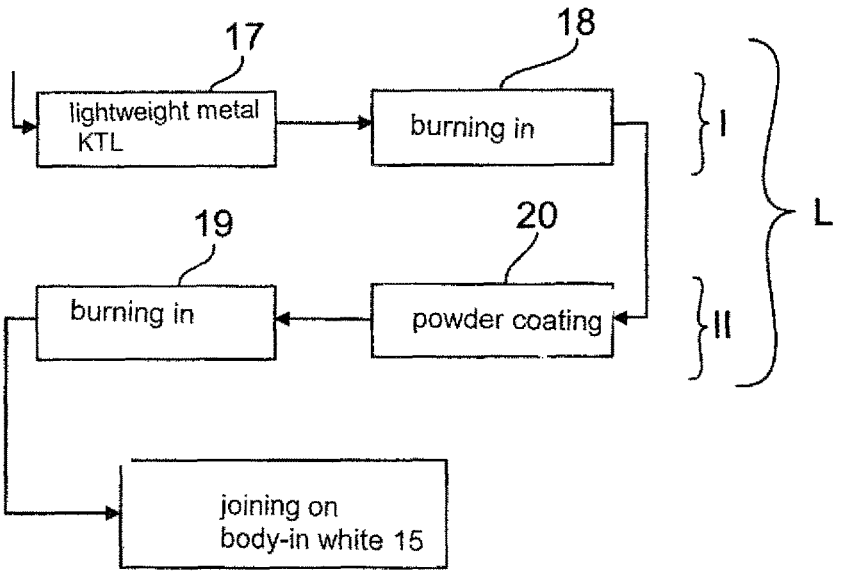

In the following a serial painting process that is performed in a painting plant is described by way of the flow chart shown in FIGS. 2 to 4, in which a passivation solution according to the invention is used: accordingly first a passivating step P (FIG. 2) is performed. In the passivating step P a degreasing, a grinding and/or pickling of he component 3 is performed. The thusly-cleaned component 3 is then subjected to a passivation according to the invention in which it is immersed in a dip bath containing of the passivation solution.

The composition of the aqueous passivation solution is generally modeled after the composition of human blood. In this regard the passivation solution contains at least the following main components whose concentration is identical to that in human blood:

NaCl with in particular 6400 mg/l
KCl with in particular 400 mg/l
$NaH_2PO_4$ with in particular 124 mg/l
$CaCl_2$ with in particular 200 mg/l
$NaHCO_3$ with in particular 3700 mg/l
Na-Pyruvate with in particular 110 mg/l
D-Ca-pantothenate with in particular 4 mg/l
Myo-Inositol with in particular 7.2 mg/l
L-Isoleucine with in particular 105 mg/l Hereby NaCl and KCl sin the passivation solution serve for activating the metal surface 25. The amino acids D-Ca-pantothenate and Myo-Inositol are mainly responsible for the coating process and in addition have a catalytic effect. The components $NaH_2PO_4$ and $CaCl_2$ support the painting process by incorporation of $Ca^{2+}$ and $PO_4^{-3}$ ions into the conversion layer 5.

The conversion layer according to the invention additionally contains carbonate containing layer components. These are provided in the passivation solution by the components $NaHCO_3$ and $CO_2$ (from the atmosphere). As a further auxiliary material of the layer formation the component Na-pyruvate serves.

Important for the coating behavior are the following components of the passivation solution:

L-Arginine with 84 mg/l
L-Cysteine with 48 mg/l
L-Histidine.HCl.H2O with 42 mg/l
L-Leucine with 105 mg/l
L-Lysin.HCl with 146 mg/l
L-Methionine with 30 mg/l
L-Penthylalanine with 66 mg/l
L-Threonine with 95 mg/l
L-Tryptophan with 16 mg/l
L-Tyrosine with 72 mg/l
L-Valine with 94 mg/l
L-Serine with 42 mg/l.

The above amino acids are also components of human blood whose concentration is retained substantially unchanged.

Overall the passivation solution according to the invention is therefore a aqueous treatment liquid whose pH value is in the range of about 7 or in the acid range. The passivation is performed in the dip bath at a treatment temperature in the range of 18 to 25° C. The treatment time depends on the used pH value, the process temperature and optionally an additional polarization and the required target thickness of the coating. After passivation the component 3 is subjected to a rinsing/drying process.

In the present application the component 3 that is coated with the conversion layer 5 in a further process step is provided (according to FIG. 3) in a coating station 17 with a lightweight metal KTL layer 6 (i.e., an organic protective layer). The lightweight metal KTL is performed conventionally in a dip method in which a direct voltage is applied between the vehicle body 1 and the dip bath, whereby the paint particles dissolved in the dip bath are attracted by the component 3 where they adhere uniformly. Additionally required pre- or post processing steps are not shown for reasons of clarity.

In a subsequent drying station 18 the component 3 passes though a continuous furnace with ta predetermined transport speed in which the lightweight metal KTL layer 6 is burned in at process temperatures in the range of for example 180° C. Subsequently in the process step II a powder layer is applied on the component 3 in a coating station 20 in which the layer 7 is applied to the component 3 (FIG. 1). In the powder coating station 20 the paint particles are transported through an electric filed from the pointed heads under voltage to the component 3, which is at ground potential. Subsequent thereto a further burning in process is performed in a further drying station 19 in a continuous furnace.

Subsequent to the component-coating process L (i.e., process steps I and II of FIG. 3) in a possible application the lightweight metal component 3 is joined to a not yet painted body in white 15 as a visible outer vehicle part. The body in white 15 is transported in a continuous process into a body painting plant (see FIG. 4). There a cataphoresis priming 25 is performed in the dip method in which a direct voltage is applied and the paint particles dissolved in the dip bath are attracted by the body in white 15 where they adhere and form a primer coat. Subsequently the primed body-in-white 15 is transported to a downstream continuous furnace 27 in which the primer coat is burned in. subsequent thereto the body-in-white 15 that is provided with the primer coat is transported to a further coating station 29 in which a KTL process is performed. Downstream of the KTL process 29 also a continuous furnace 31 is arranged in which the coating is burned in at high temperature. Subsequently in a further coating station 33 a conational automobile four layer paint construction 9 is applied which is then subjected to a burning in process 35.

Figure 4:
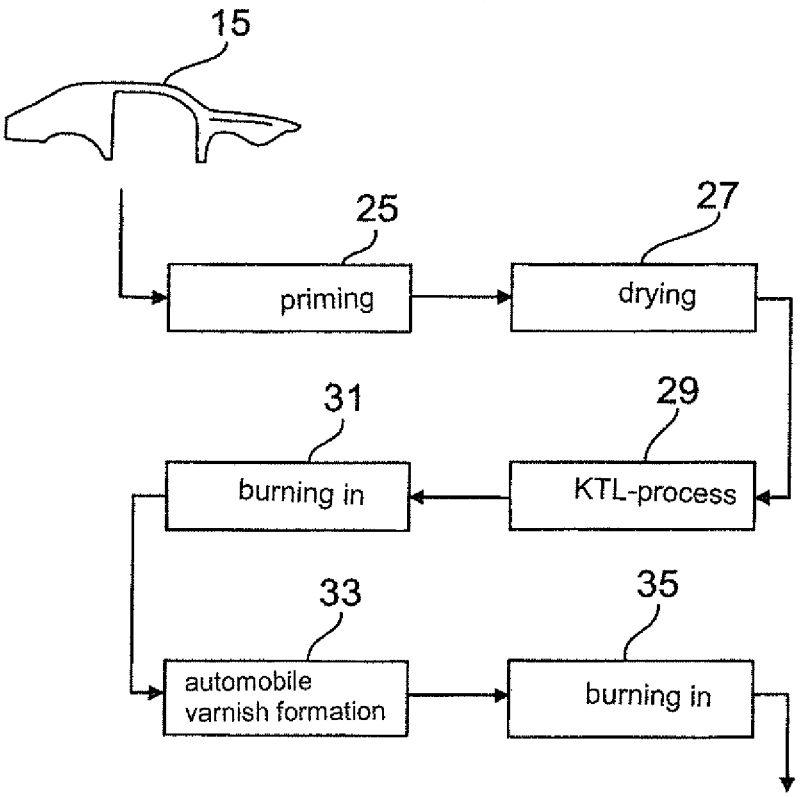

The vehicle body paining process shown in FIG. 4 is performed with an already pre-coated lightweight metal component 3. This means that the lightweight metal component 3 is eclectically insulated so that the KTL layer applied in the body in white painting process no longer adheres, whereas the convectional varnish construction 9 (i.e., a four layer construction) can be applied to the powder layer of the lightweight metal component 3 without problems.

Figure 5:
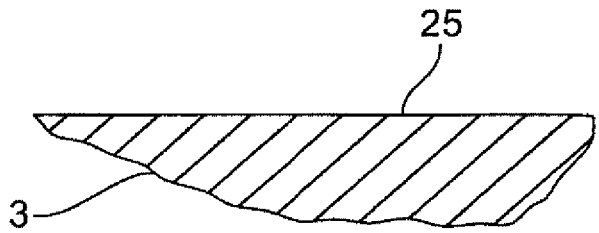
FIGS. 5 to 7 respective strongly enlarged partial sectional views, which illustrate the coating process up to the application of the lightweight metal KTL layer.
Figure 6:
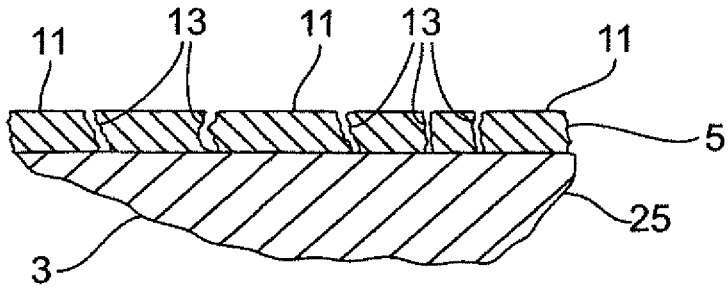
Figure 7:
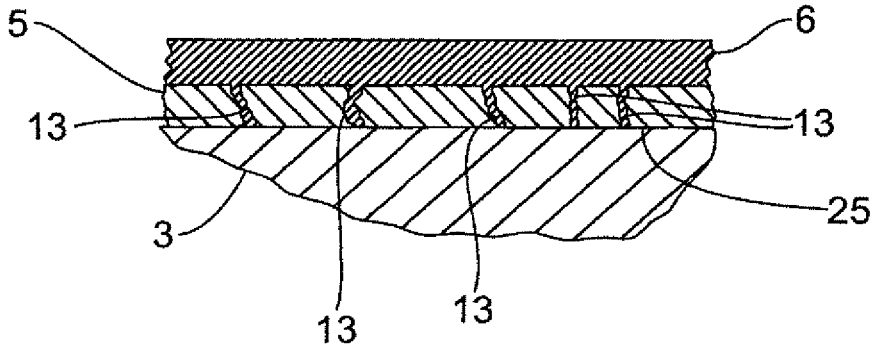

FIGS. 5 to 7 show in views corresponding to that of FIG. 1 the lightweight metal component 3 with cleaned and exposed metallic surface 25. FIG. 6 shows the lightweight metal component 3 after passivation and storage. According to this the conversion layer 5 is applied on the metallic surface 25 of the lightweight metal component, i.e., with the floe morphology according to the invention, i.e., with floe like individual fragments 11 and interposed cracks 13. FIG. 7 shows the lightweight metal component 3 after the lightweight metal KTL process in which the staring component of the lightweight KTL layer 6 permeates the crack structure 13 of the conversion layer 5, whereby the adhesive connection between the conversion layer 5 and the lightweight metal KTL layer 6 is significantly increased.

What is claimed is:

1. A method for passivating a metallic surface of a lightweight metal component, said method comprising:

in a passivating step applying an aqueous passivation solution on the metallic surface of the lightweight metal component, thereby generating on the metallic component surface a conversion layer which contains calcium phosphate, amino acids, and further contains oxides and hydroxides of the lightweight metal component; and in a first coating step forming a lightweight metal KTL (cathodic dip painting) layer as an organic protective layer in a dip bath as paint particles dissolved in the dip bath are attracted by the lightweight metal component and adhere to the lightweight metal component.

2. The method of claim 1, further comprising at least one further coating step in which at least one further layer is applied.

3. The method of claim 2, wherein the at least one further layer is applied in a powder coating process with applied direct voltage.

4. The method of claim 1, wherein at least the metallic surface of the component is formed by a lightweight metal.

5. The method of claim 4, wherein the lightweight metal is magnesium, aluminum or alloys thereof.

6. The method of claim 1, wherein the passivation solution contains at least one of the following components as activators for activating the metal surface of the components:

NaCl at a concentration between 5000 and 8000, and

KCl with a concentration between 300 and 500.

7. The method of claim 1, wherein the passivation solution contains as a catalyst and layer former D-Ca-pantothenate at a concentration between 2 and 30 mg/l.

8. The method of claim 1, wherein the passivation solution contains L-Isoleucine as a layer adhesion agent at a concentration between 90 and 150 mg/l.

9. The method of claim 1, wherein the passivation solution contains at least one of the following components, which are integrated into the conversion layer as fragments for supporting formation of the conversion layer:

$NaH_2PO_4$ at a concentration between 100 and 170 mg/l;

$CaCl_2$) at a concentration between 170 and 300 mg/l.

10. The method of claim 1, wherein the conversion layer contains carbonate containing components for supporting formation of the conversion layer, and wherein the passivation solution contains $NaHCO_3$ for providing the carbonate containing components.

11. The method of claim 1, wherein the passivation solution contains Na-pyruvate at a concentration between 90-170 mg/l for supporting formation of the conversion layer.

12. The method of claim 1, wherein a pH value of the passivation solution is in a neutral to acid range.

13. The method of claim 1, wherein the passivation solution contains further the following components whose concentration is modeled according to their respective concentrations in human blood:

NaCl at 6400 mg/l,

KCl at 400 mg/l, $NaH_2PO_4$ at 124 mg/l, $CaCl_2$ at 200 mg/l, $NaHCO_3$ at 3700 mg/,l

Na-Pyruvate at 110 mg/l,

D-Ca-pantothenate at 4 mg/l,

Myo-Inositol at 7.2 mg/l,

L-Isoleucine at 105 mg/l.

14. The method of claim 1, wherein the passivation solution contains at least one of the following components for increasing coating properties:

L-Arginine at 50 to 120 mg/l,

L-Cysteine with 30 to 80,

L-Histidine.HCl.$H_2O$ at 25 to 65 mg/l,

L-Leucine at 70 to 140 mg/l,

L-Lysin.HCl at 110 to 170 mg/l,

L-Methionine at 20 to 50 mg/l,

L-Penthylalanine at 40 to 80 mg/l,

L-Threonine at 60 to 120 mg/l,

L-Tryptophan at 13 to 20 mg/l,

L-Tyrosine at 40 to 90 mg/l,
L-Valine at 60 to 120 mg/l,
L-Serine at 20 to 60 mg/l,
Colin chloride at 2 to 10 mg/l,
Folic acid at 2 to 10 mg/l,
Nicotine amide at 2 to 10 mg/l,
Pyridoxale.HCl at 2 to 10 mg/l,
Riboflavine at 0.2 to 1 mg/l,
Thiamine-HCl at 2 to 10 mg/l.

15. The method of claim 1, wherein the conversion layer of the component is at least partially covered with a layer in a subsequent coating step.

16. The method of claim 1, wherein the conversion layer has a floe-like layer morphology with crack structures, said layer morphology ensuring in the first coating step a sufficient residual conductivity between the dip bath and the lightweight metal component and/or increasing an adhesive connection between the conversion layer and the lightweight metal KTL layer by entering of a liquid starting component of the lightweight metal KTL layer into the cracks.

17. The method of claim 1, wherein the cathodic dip painting includes a dip method with applied direct voltage.

* * * * *